US006279868B1

(12) United States Patent
Eyring et al.

(10) Patent No.: US 6,279,868 B1
(45) Date of Patent: Aug. 28, 2001

(54) EXTRUDED PLASTIC RUSTICATION DEVICE FOR FORMING DECORATIVE CONCRETE PANELS

(75) Inventors: Kurt S. Eyring; Kyozaburo Takagi, both of Centerville; Matthew Packer, West Carrollton, all of OH (US)

(73) Assignee: Miller-Valentine Construction Inc., Dayton, OH (US)

( * ) Notice: Subject to any disclaimer, the term of this patent is extended or adjusted under 35 U.S.C. 154(b) by 0 days.

(21) Appl. No.: 09/418,384

(22) Filed: Oct. 14, 1999

(51) Int. Cl.[7] ..... B28B 7/16
(52) U.S. Cl. ..... 249/177; 249/35; 249/187.1
(58) Field of Search ..... 249/35, 39, 187.1, 249/188, 189, 177

(56) References Cited

U.S. PATENT DOCUMENTS

D. 428,162 * 7/2000 Eyring et al. ..... D25/121
2,021,210 * 11/1935 Thorn ..... 249/1
3,148,433 * 9/1964 Carriker ..... 249/176
3,632,078 * 1/1972 Dashew ..... 249/183
4,089,502 * 5/1978 Miller ..... 249/177
4,659,057 * 4/1987 Felter ..... 249/97

* cited by examiner

*Primary Examiner*—Nam Nguyen
*Assistant Examiner*—Donald Heckenberg
(74) *Attorney, Agent, or Firm*—Jacox, Meckstroth & Jenkins

(57) ABSTRACT

Tilt-up concrete wall panels are poured on a horizontal concrete floor or forming surface and are provided with decorative recesses or rustications each formed by a device including an elongated clip or base member or channel of extruded semi-rigid plastics material and secured by fasteners to the forming surface. The base channel has upwardly projecting walls with inwardly projecting opposing teeth which releasably clip or engage outwardly projecting teeth on parallel spaced inner support walls of a generally flat rustication member of extruded semi-rigid plastics material. The rustication member is extruded with outwardly and downwardly projecting side or edge walls which have tapered lower edge portions engaging the forming surface to form precision recesses with beveled edge surfaces within the concrete panels.

14 Claims, 1 Drawing Sheet

EXTRUDED PLASTIC RUSTICATION DEVICE FOR FORMING DECORATIVE CONCRETE PANELS

BACKGROUND OF THE INVENTION

In the construction of commercial and industrial buildings of the type which has concrete wall panels formed by using the tilt-slab method, a concrete building floor is normally poured in place and is then coated with a release agent to form a horizontal forming surface for the wall panels. The forms for producing the concrete wall panels are then placed on the forming surface, and reinforcing steel or rebars are positioned within the forms. When concrete is poured within the forms, the top edges of the forms are used as a guide for a screed which forms the flat top surfaces of the wall panels. After the concrete wall panels are cured, they are lifted or tilted by a crane to vertical positions to form the outer walls of the building.

When it is desired to form decorative areas or bands, known as rustications, within the surfaces of the concrete wall panels, recess forming strips of wood are commonly attached to the forming surface in a predetermined pattern, and the strips are treated or sprayed with a concrete release agent. However, it is not uncommon for the wood strips to be destroyed or damaged either when the cured concrete wall panels are tilted from the forming surface to vertical positions, or when the strips are removed from the forming surface. As a result, the recess forming boards or strips cannot be reused.

SUMMARY OF THE INVENTION

The present invention is directed to an improved rustication device for forming decorative areas or recesses in concrete wall panels poured onto a concrete floor or other forming surface and which provides the desirable advantages of durability, reusability and economy of construction in addition to providing high quality and precision decorative recesses within the surfaces of the concrete panels. The rustication device of the invention may also be cut to desired lengths and with mitered ends using conventional cutting tools, minimizes the use of fasteners such and screws and nails, and requires no special coating or concrete release agent on the device.

In accordance with a preferred embodiment of the invention, a rustication device includes an elongated base clip member or channel of extruded semi-rigid plastics material and which is adapted to be secured by screws to a concrete floor or other forming surface. The base channel has upwardly projecting side walls with inwardly projecting and longitudinally extending opposing teeth. The teeth releasably engage outwardly projecting teeth on internal space support walls of a rustication member of extruded semi-rigid plastics material. Inclined end walls project outwardly and downwardly from the top wall of the rustication member and have lower tapered edge portions for engaging the forming surface to form recesses having beveled edge surfaces within the concrete panels. Vertical stem or parallel spaced support walls also project downwardly from the top wall and engage the forming surface.

Other features and advantages of the invention will be apparent from the following description, the accompanying drawing and the appended claims.

DESCRIPTION OF THE PREFERRED EMBODIMENT

Figure 1:
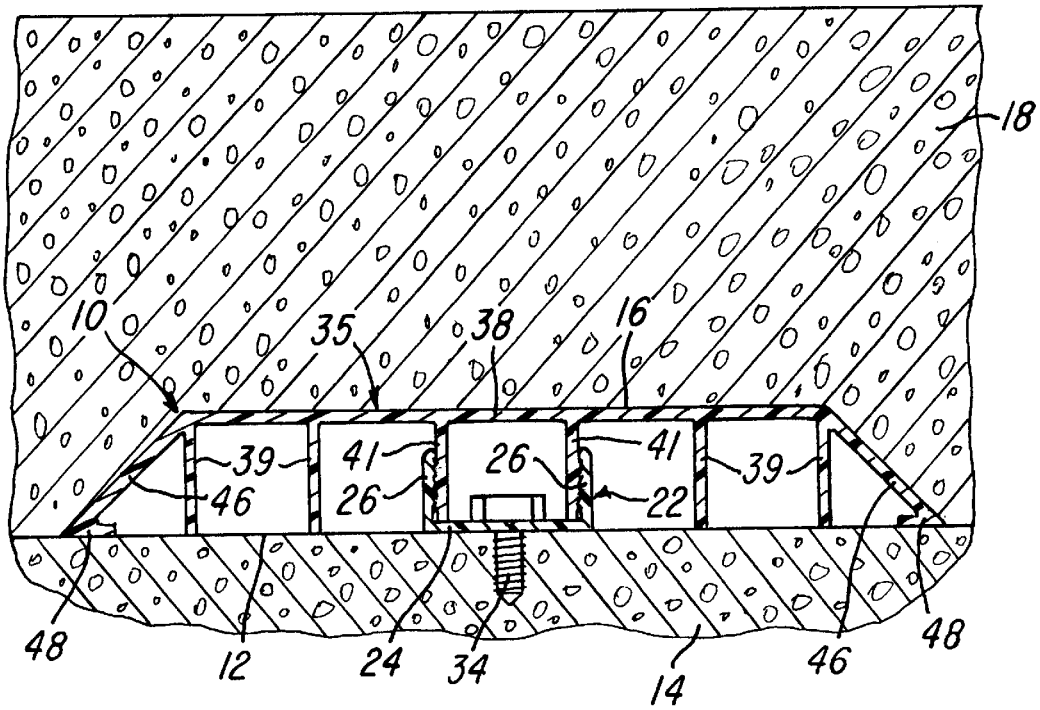
FIG. 1 is a section of an assembled and installed rustication device constructed in accordance with the invention and illustrating its use for forming a recess within a concrete wall panel poured onto a forming surface.
Figure 2:
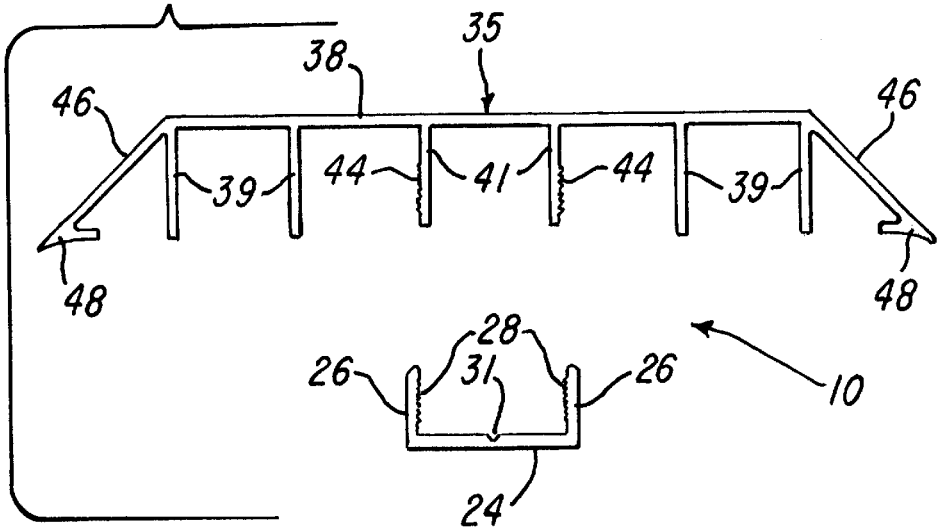
FIG. 2 is an exploded end view of the rustication device constructed in accordance with the invention and shown in FIG. 1.

Referring to FIG. 1, an elongated rustication device 10 is constructed in accordance with the invention and is mounted on a forming surface 12 formed by a concrete floor 14 and with the surface 12 sprayed with a concrete release agent. The rustication device 10 is used to form a decorative cavity or recess 16 within a reinforced concrete wall panel 18 which is poured onto the floor or forming surface 12. As mentioned above, after the concrete wall panel 18 is cured, the horizontal panel is lifted or tilted to a vertical position with the aid of a crane to form the outer wall of the building.

In accordance with the invention, the rustication device 10 includes an elongated base clip member or channel 22 which is extruded of a semi-rigid plastics material such as polyvinylchloride (PVC). The elongated base member or channel 22 includes a bottom wall 24 which integrally connects parallel spaced vertical side walls 26 having a series of inwardly projecting opposing saw tooth locking ribs or teeth 28. A longitudinally extending depression or groove 31 extends within the top center of the bottom wall 24. The groove 31 provides for conveniently locating a drill bit to form longitudinally spaced holes within the channel 22 and the concrete floor 14 for receiving corresponding threaded fasteners or masonry anchors and screws 34 which secure the channel 22 to the forming surface 12. Preferably, the spacing between the walls 26 is about 23 mm.

The rustication device 10 also includes a generally flat rustication member 35 which is extruded of the same material as the base member or channel 22 and includes a longitudinally extending generally flat top wall 38 and a plurality of parallel spaced support stems or walls 39 and 41 integrally connected by the top wall 38. The inner walls 41 have outer surfaces with outwardly projecting saw tooth locking ribs or teeth 44 which releasably clip or engage in snap-fit relation the opposing saw tooth locking ribs or teeth 28 on the inner surfaces of the side walls 26 of the base clip channel 22. The extruded rustication member 35 also includes opposite side or edge walls 46 which are integrally extruded and project downwardly and outwardly from the top wall 38 at an angle of about 45°. The inclined walls 46 have lower tapered edge portions 48 which positively engage and seat on the forming surface 12, as shown in FIG. 1.

The rustication device 10 is installed by first securing the elongated base clip member or channel 22 to the forming surface 12 by the longitudinally spaced fasteners or screws 34. One of the base channels 22 is located on the surface 12 wherever it is desired to have a linear cavity or recess within a poured concrete panel 18. One of the elongated rustication members 35 is then pressed downwardly into each base clip or channel 22 until the bottom edge portions 28 of the walls 46 and the bottom edges of the walls 39 seat on the forming surface 12. If the surface 12 is flat, the bottom edges of the walls 41 will also seat on the bottom wall 24 of the base channel 22. After the concrete panels 18 are poured and cured, they are successively lifted or tilted to vertical positions, at which time each panel separates easily and cleanly from each rustication device 10 within the panel. Each rustication member 35 may then be pulled upwardly to release it from its corresponding retaining clip or channel 22 which is then removed by removing the screws or fasteners 34.

From the drawing and the above description, it is apparent that a rustication device constructed in accordance with the present invention, provides desirable features and advantages. For example, the extruded semi-rigid plastic device is durable and reusable and forms a high quality cavity or recess with precision beveled edge surfaces within the concrete wall panel. The rustication member 35 requires no special coating or concrete release agent, and no fasteners are required to retain the rustication member 35 so that the member 35 may be reused many times. In addition, the strength of the base member or channel 22 also minimizes the number of screws or fasteners 34, and the interfitting teeth 28 and 44 cooperate with the slight flexibility of the walls 26 to form a positive but releasable connection or coupling of the member 35 to the member 22 without the use of any separate fasteners. The adjustable interfitting teeth 28 and 44 also assure that the tapered bottom edge portions 48 of the bevel forming walls 46 engage and seal with the forming surface 12, even when the forming surface 12 is somewhat irregular and not perfectly smooth and flat. That is, the edge portions 48 may engage the forming surface 12 before the bottom edges of the walls 41 engage the bottom surface 24 of the base channel retaining channel 22. It is also within the scope of the invention to construct the rustication member 35 in various widths and with various cross-sectional configurations or profiles according the appearance desired for the recess 16.

While the form of rustication device herein described constitutes a preferred embodiment of the invention, it is to be understood that the invention is not limited to this precise form of device, and that changes may be made therein without departing from the scope and spirit of the invention as defined in the appended claims.

What is claimed is:

1. A device for forming a decorative recess in a concrete panel poured onto a forming surface, comprising a first extrusion of plastics material and forming an elongated one-piece base member having a longitudinally extending base wall for mounting on the forming surface, a second extrusion of plastics material and forming an elongated one-piece rustication member including a top wall integrally connecting longitudinally extending opposite side walls projecting from said top wall, said side walls having lower edge portions disposed for engaging the forming surface, said base member and said rustication member including longitudinally extending parallel connecting walls spaced between said side walls of said rustication member and having longitudinally extending interfitting teeth locking said members together, and said interfitting teeth on said connecting walls being releasable in response to pulling said rustication member from said base member.

2. A device as defined in claim 1 wherein said rustication member has a plurality of longitudinally extending and parallel spaced support walls integrally connected by said top wall and having distal edge surfaces positioned for engaging the forming surface.

3. A device as defined in claim 1 wherein said lower edge portion of each of said side walls is tapered to a V-shaped flexible edge for forming a seal with an irregular forming surface.

4. A device as defined in claim 1 wherein said connecting walls of said base member and said rustication member cooperate to define a longitudinally extending recess for receiving longitudinally spaced fasteners securing said base member to the forming surface.

5. A device as defined in claim 1 wherein said base wall of said base member has a longitudinally extending groove for locating the pointed end of a drill bit to form holes within said base wall for receiving fasteners to secure said base member to the forming surface.

6. A device as defined in claim 1 wherein all of said walls of said rustication member have a substantially uniform thickness.

7. A device for forming a decorative recess in a concrete panel poured onto a forming surface, comprising a first extrusion of plastics material and forming an elongated one-piece channel-shaped base member having a longitudinally extending base wall for mounting on the forming surface and longitudinally extending and parallel spaced connecting walls each having longitudinally extending teeth, a second extrusion of plastics material and forming an elongated one-piece rustication member including a top wall integrally connecting longitudinally extending opposite side walls projecting from said top wall, said side walls having lower edge portions disposed for engaging the forming surface, said rustication member further including longitudinally extending parallel spaced connecting walls spaced between said side walls and integrally connected by said top wall, said connecting walls having longitudinally extending teeth interfitting with said teeth on said connecting walls of said base member and locking said members together, and said teeth on said connecting walls of said rustication member being releasable from said teeth on said connecting walls of said base member in response to pulling said rustication member from said base member.

8. A device as defined in claim 7 wherein said rustication member has a plurality of longitudinally extending and parallel spaced support walls integrally connected by said top wall and having distal edge surfaces positioned for engaging the forming surface.

9. A device as defined in claim 7 wherein said lower edge portion of each of said side walls is tapered to a V-shaped flexible edge for forming a seal with an irregular forming surface.

10. A device as defined in claim 7 wherein said parallel spaced connecting walls of said base member and said parallel spaced connecting walls of said rustication member cooperate to define a longitudinally extending enclosed recess for receiving and protecting longitudinally spaced fasteners securing said base member to the forming surface.

11. A device as defined in claim 7 wherein said base wall of said base member has a longitudinally extending groove for locating the pointed end of a drill bit to form holes within said base wall for receiving fasteners to secure said base member to the forming surface.

12. A device as defined in claim 7 wherein all of said walls of said rustication member have a substantially uniform thickness.

13. A device as defined in claim 7 wherein said parallel spaced connecting walls of said rustication member have distal edge surfaces seated on said base wall of said base member.

14. A device as defined in claim 7 wherein said longitudinally extending side walls of said rustication member slope downwardly and laterally outwardly from said top wall and have V-shaped and flexible distal edges for forming a seal with an irregular forming surface.

* * * * *